US010694919B2

(12) United States Patent
Gephart et al.

(10) Patent No.: US 10,694,919 B2
(45) Date of Patent: Jun. 30, 2020

(54) DISH TREATING APPLIANCE WITH DIVERTER VALVE POSITION SENSING

(71) Applicant: WHIRLPOOL CORPORATION, Benton Harbor, MI (US)

(72) Inventors: Jonathan Gephart, Saint Joseph, MI (US); Antony Rappette, Benton Harbor, MI (US); Peter Richmond, Berrien Springs, MI (US); Steven Vornsand, Lake in the Hills, IL (US); Rodney Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 167 days.

(21) Appl. No.: 15/939,872

(22) Filed: Mar. 29, 2018

(65) Prior Publication Data

US 2018/0220863 A1 Aug. 9, 2018

Related U.S. Application Data

(62) Division of application No. 14/973,218, filed on Dec. 17, 2015, now Pat. No. 10,010,235.

(51) Int. Cl.
*A47L 15/42* (2006.01)
*A47L 15/50* (2006.01)

(52) U.S. Cl.
CPC ..... *A47L 15/4221* (2013.01); *A47L 15/502* (2013.01); *A47L 15/507* (2013.01); *A47L 2401/06* (2013.01); *A47L 2401/14* (2013.01); *A47L 2401/30* (2013.01); *A47L 2501/26* (2013.01)

(58) Field of Classification Search
CPC ..... A47L 15/4221; A47L 2401/06; A47L 15/00–508
See application file for complete search history.

(56) References Cited

U.S. PATENT DOCUMENTS

| | | | |
|---|---|---|---|
| 5,429,146 | A | 7/1995 | Graf et al. |
| 7,594,513 | B2 | 9/2009 | VanderRoest et al. |
| 7,896,977 | B2 | 3/2011 | Gillum et al. |
| 8,858,729 | B2 | 10/2014 | Buddharaju et al. |
| 2003/0168087 | A1 | 9/2003 | Inui et al. |
| 2004/0173249 | A1 | 9/2004 | Assmann et al. |
| 2013/0000762 | A1 | 1/2013 | Buddharaju et al. |
| 2014/0076439 | A1 | 3/2014 | Brignone et al. |
| 2015/0245762 | A1 | 9/2015 | Tuller |

FOREIGN PATENT DOCUMENTS

| | | | |
|---|---|---|---|
| DE | 3810648 | A1 | 10/1989 |
| EP | 0585538 | A1 | 3/1994 |
| EP | 2532295 | A1 | 12/2012 |
| WO | 2010052040 | A2 | 5/2010 |
| WO | 2013132458 | A1 | 9/2013 |

OTHER PUBLICATIONS

European Extended Search Report for Counterpart EP 16204545.4, dated Feb. 23, 2017, 6 pgs.

*Primary Examiner* — Spencer E Bell
(74) *Attorney, Agent, or Firm* — McGarry Bair PC

(57) ABSTRACT

A diverter valve assembly includes a manifold defining a plenum with an inlet and multiple outlets, a membrane movably mounted within the plenum and having at least one through opening, which is sequentially aligned with the multiple outlets upon movement of the membrane, indicia provided on the membrane corresponding to each of the multiple outlets, and a sensor configured to sense the indicia and provide an output of the sensed indicia.

20 Claims, 9 Drawing Sheets

DISH TREATING APPLIANCE WITH DIVERTER VALVE POSITION SENSING

CROSS-REFERENCE TO RELATED APPLICATIONS

This application is a divisional application of U.S. patent application Ser. No. 14/973,218, entitled "Dish Treating Appliance with Diverter Valve Position Sensing," filed Dec. 17, 2015, now U.S. Pat. No. 10,010,235, issued Jul. 3, 2018, which is incorporated herein by reference in its entirety.

BACKGROUND

Contemporary automatic dish treating appliances for use in a typical household include a tub and at least one rack or basket for supporting soiled dishes within the tub. A spraying system can be provided for recirculating liquid throughout the tub to remove soils from the dishes. The spraying system can include various sprayers including one or more rotatable sprayers. A diverter valve is provided to selectively couple the multiple sprayers to a liquid supply. Traditionally, the diverter valve is in the form of a rotary disk to selectively supply liquid from a recirculation pump to the various sprayers.

BRIEF SUMMARY

In one aspect, illustrative embodiments in accordance with the present disclosure relate to a diverter valve assembly comprising a manifold defining a plenum with an inlet and multiple outlets, a membrane movably mounted within the plenum and having at least one through opening, which is sequentially aligned with the multiple outlets upon movement of the membrane, indicia provided on the membrane corresponding to each of the multiple outlets, and a sensor configured to sense the indicia and provide an output of the sensed indicia, wherein as the membrane is moved within the plenum, the sensor senses the indicia and provides an output indicative of which of the multiple outlets the through opening is aligned with to define an aligned outlet.

DESCRIPTION OF EMBODIMENTS OF THE INVENTION

Figure 1:
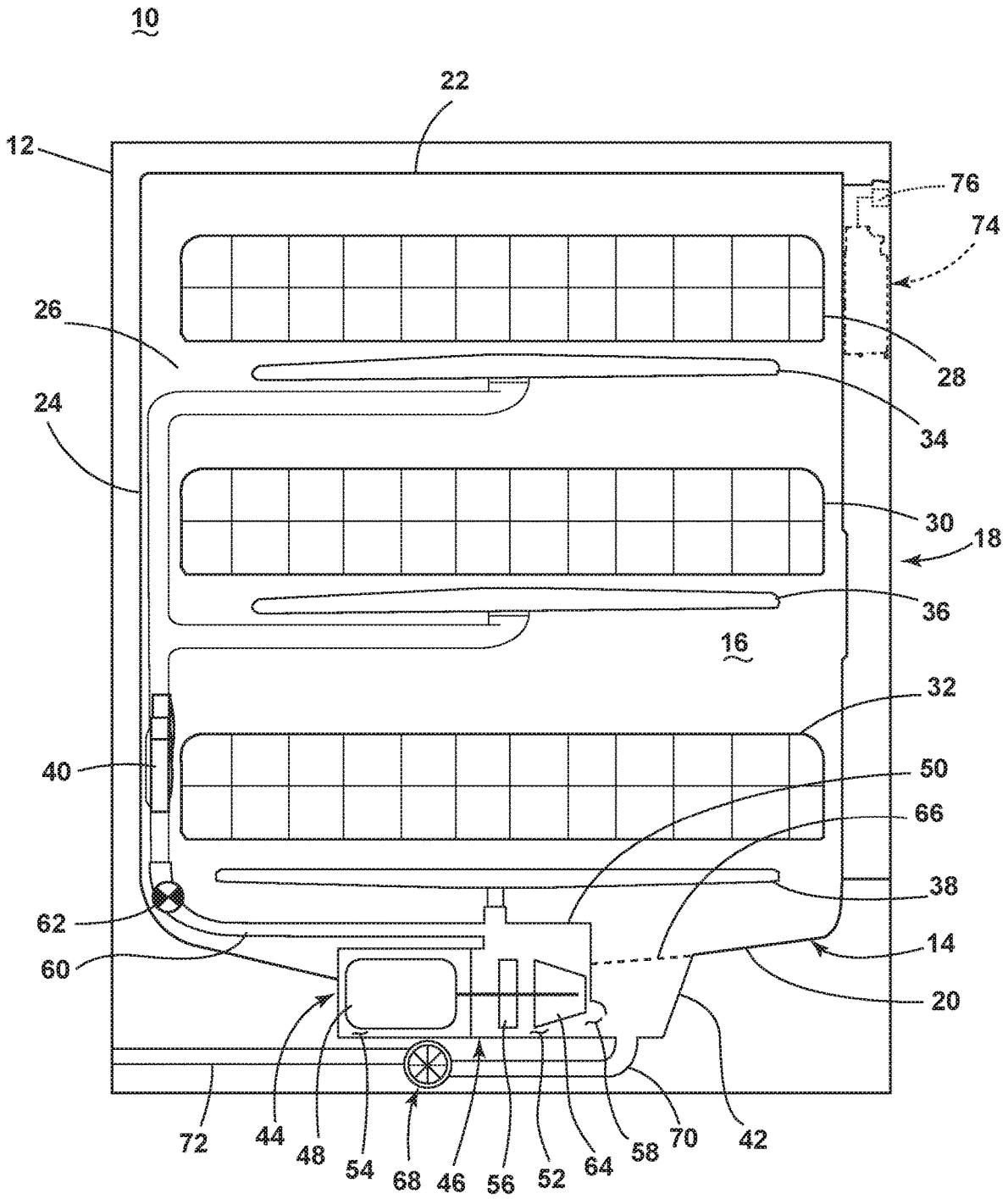
FIG. 1 is a partial schematic cross-sectional view of a dish treating appliance with a door closed with a diverter valve according to an embodiment of the invention.

FIG. 1 is a schematic view of an example automatic dish treating appliance 10 in accordance with one embodiment of the invention. The dish treating appliance 10 can treat dishes according to an automatic cycle of operation. Depending on whether the dish treating appliance 10 is a stand-alone or built-in, the dish treating appliance includes a cabinet 12 that may be a chassis/frame with or without panels attached, respectively. The dish treating appliance 10 shares many features of a conventional automatic dish treating appliance, which will not be described in detail herein except as necessary for a complete understanding of the invention. An open-faced tub 14 is within the cabinet 12 and may at least partially define a treating chamber 16, having an open face, for washing dishes.

A closure element, such as a door assembly 18, may be movably mounted to the dish treating appliance 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 may be secured to the lower front edge of the cabinet 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open. Alternatively, the closure element may be slidable relative to the cabinet 12, such as in a drawer-type dish treating appliance, wherein the access opening for the treating chamber 16 is formed by an open-top tub. Other configurations of the closure element relative to the cabinet 12 and the tub 14 are also within the scope of the invention.

The tub 14 includes a bottom wall 20 and a top wall 22, with a rear wall 24 joining the bottom and top walls 20, 22, and two side walls 26 joining the bottom and top walls 20, 22 and extending from the rear wall 24 toward the open face of the tub 14. When the door assembly 18 is closed, the door assembly 18 effectively forms a front wall of the tub 14 to enclose the treating chamber 16.

Dish holders, illustrated in the form of upper, middle, and lower dish racks 28, 30, 32, may be located within the treating chamber 16 and receive dishes for treatment, such as washing. The upper, middle, and lower racks 28, 30, 32 are typically mounted for slidable movement in and out of the treating chamber 16 for ease of loading and unloading. Other dish holders may be provided, such as a silverware basket, separate from or combined with the upper, middle, and lower racks 28, 30, 32. As used in this description, the term "dish(es)" is intended to be generic to any item, single or plural, that may be treated in the dish treating appliance 10, including, without limitation, dishes, plates, pots, bowls, pans, glassware, silverware, or any other washable item.

A spray system may be provided for spraying liquid in the treating chamber 16 and may be provided in the form of, for example, an upper spray assembly 34, a middle spray assembly 36, and a lower spray assembly 38. The upper spray assembly 34, the middle spray assembly 36, and the lower spray assembly 38 are located, respectively, beneath the upper rack 28, beneath the middle rack 30, and beneath the lower rack 32 and are illustrated as rotating spray arms by example but are not limited to such positions and sprayer type. The spray system may further include an additional spray assembly 40. For example, a distribution header or spray manifold may be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety. The illustrated additional spray assembly 40 is illustrated as being located adjacent the lower dish rack 32 along the rear wall 24 of the treating chamber 16.

A recirculation system may be provided for recirculating liquid from the treating chamber 16 to the spray system. The recirculation system may include a sump 42 and a pump assembly 44. The sump 42 collects the liquid sprayed in the treating chamber 16 and may be formed by a sloped or recessed portion of the bottom wall 20 of the tub 14, or may be separate from the bottom wall 20. The pump assembly 44 may include a recirculation pump 46 fluidly coupling the treating chamber 16 to the liquid spraying system and a motor 48 drivingly coupled to the recirculation pump 46. The recirculation pump 46 and motor 48 may be enclosed within a housing 50 having a pump chamber 52 and a motor chamber 54, respectively. The recirculation pump 46 includes an impeller 56 within the pump chamber 52 in fluid communication with the sump 42 via an inlet 58. The lower portion of the housing 50 defining the pump chamber 52 may define a portion of the sump 42 or a remote sump that is coupled to the treating chamber 16 to collect liquid and soil particles via the inlet 58.

During a wash or recirculation cycle, the impeller 56, driven by the motor 48, may draw liquid from the sump 42 through the inlet 58, and the liquid may be simultaneously or selectively pumped through a supply conduit 60 to each of the spray assemblies 34, 36, 38, 40 for selective spraying. A diverter valve 62 may be provided within a portion of the supply conduit 60 for selectively controlling the supply of liquid to one or more of the spray assemblies 34, 36, 38, 40 at a time. As such, downstream of the diverter valve 62, the supply conduit 60 may branch into multiple conduits, each supplying at least one of the spray assemblies 34, 36, 38, 40. While not shown, a liquid supply system may include a water supply conduit coupled with a household water supply for supplying water to the treating chamber 16. Such a diverter valve is set forth in detail in U.S. patent application Ser. No. 14/818,667, filed Aug. 5, 2015, now U.S. Pat. No. 10,010,234, issued Jul. 3, 2018, and titled "Diverter Valve and Dishwasher with Diverter Valve," which is incorporated herein by reference in its entirety. The structure and function of the diverter valve 62 as disclosed in the previously identified Application will be discussed here only as it relates to the current invention.

A filter assembly 64 may be provided between the sump 42 and impeller 56 for allowing soils of only a predetermined size into the impeller 56. In some embodiments, the filter assembly 64 may include a rotatable filter provided within the pump chamber 52 and driven by the motor 48 for rotation with the impeller 56. In other embodiments, the filter assembly 64 may be non-rotatable. Other apparatus for filtering the wash liquid may also be provided in addition to or instead of the filter assembly 64. In one non-limiting example, a coarse screen filter 66 may be provided at the bottom wall 20 of the tub 14 to prevent large objects or soils from entering the sump 42.

The rotational axes of the motor 48, impeller 56, and filter assembly 64 are illustrated herein as being horizontally-oriented, with respect to the normal operational position of the dish treating appliance 10. In other embodiments of the invention, the rotational axes of the motor 48, impeller 56, and/or filter assembly 64 may be vertically-oriented, or at an oblique angle between horizontal and vertical.

The pump assembly 44 may further include a drain pump 68. The drain pump 68 may be driven by a separate motor (not shown) or by the motor 48 for the recirculation pump 46, and may draw liquid from the sump 42, through a sump outlet conduit 70, and pump the liquid out of the dish treating appliance 10 to a household drain line (not shown) via, for example, a drain conduit 72.

In accordance with one aspect of the present invention, at least a portion of the pump assembly 44 can be located above the bottom wall 20 of the tub 14. By having the pump assembly 44 at least partially above the bottom wall 20, the bottom wall 20 can be lowered closer to the bottom of the cabinet 12 or the floor on which the dish treating appliance rests. Thus, the distance between the bottom wall 20 and the top wall 22 can be increased, which increases the overall capacity of the tub 14, which may be defined by the volume of the treating chamber 16 or by the number of items that can be received by the dish racks 28, 30, 32. This can also more than offset any capacity potentially lost by the placement of the pump assembly 44 partially above the bottom wall 20, so that an overall capacity increase is still gained in comparison to a dish treating appliance which positions the entire pump assembly below the bottom wall.

As shown, the bottom wall 20 is sloped downwardly toward the sump 42. In other embodiments, the bottom wall 20 can be flat. The bottom wall 20 can terminate at the junction with the sump 42 and the pump assembly 44, with the sump extending below the bottom wall 20 and at least a portion of the pump assembly 44 extending above the bottom wall 20. In some embodiments the portion of the pump assembly 44 may extend above the entire bottom wall 20, and in other embodiments the portion of the pump assembly 44 may extend above the portion of the bottom wall 20 that meets the pump assembly 44.

As shown, a portion of the recirculation pump 46 and the motor 48 are located above the bottom wall 20 of the tub 14. Portions of the recirculation pump 46 and the motor 48 are also located beneath the bottom wall 20. In addition, the filter assembly 64 is also partially located above the bottom wall 20. The drain pump 68 is shown as located fully beneath the bottom wall 20 of the tub 14, but in other embodiments of the invention the drain pump 68 may also be located at least partially above the bottom wall 20. The diverter valve 62 is shown as located fully above the bottom wall 20 of the tub 14, but in other embodiments of the invention the diverter valve 62 may also be located at least partially below the bottom wall 20.

Due to the lower bottom wall 20, the capacity of the tub 14 is larger than that for a standard dish treating appliance. For example, the capacity of the tub 14 can be sufficient to accommodate at least three dish racks 28, 30, 32 instead of the standard two racks. Further, one or more of the dish racks 28, 30, 32 of the dish treating appliance may be larger than typical racks. For example, in the embodiment shown, the upper rack 28 may be larger than a typical utensil rack found in some dish treating appliances, while still maintaining a height clearance for the lower racks to accommodate taller items, such as baking sheets and taller bowls. As illustrated, the upper rack 28 can be sized to hold shorter bowls, food storage containers, or glasses. Details of a suitable upper rack 28 can be found in U.S. application Ser. No. 14/620,688, filed Feb. 12, 2015, now U.S. Publication No. 20150245762, published Sep. 3, 2015, now abandoned, which is incorporated herein by reference in its entirety.

A control system including a controller 74 may also be included in the dish treating appliance 10, which may be operably coupled with various components of the dish treating appliance 10 to implement a cycle of operation. The controller 74 may be located within the door assembly 18 as illustrated, or it may alternatively be located somewhere within the cabinet 12. The controller 74 may also be operably coupled with a control panel or user interface 76 for receiving user-selected inputs and communicating information to the user. The user interface 76 may include operational controls such as dials, lights, switches, and displays enabling a user to input commands, such as a cycle of operation, to the controller 74 and receive information.

Figure 2:
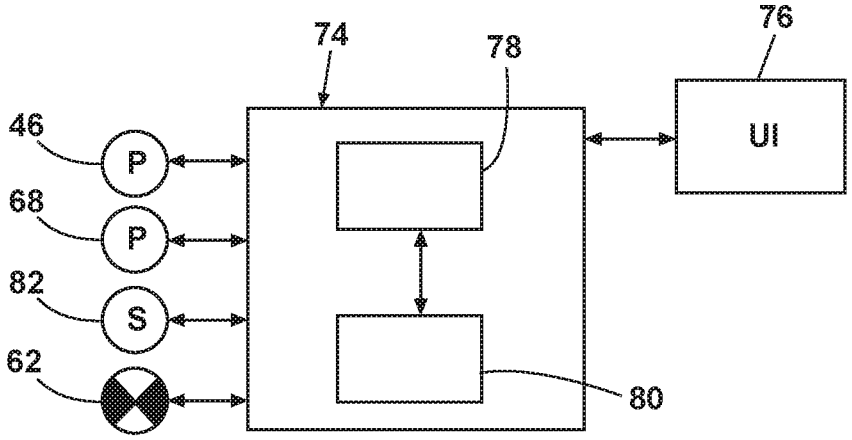
FIG. 2 is a schematic view of a control system of the dish treating appliance of FIG. 1.

As illustrated schematically in FIG. 2, the controller 74 may be coupled with the recirculation pump 46 for recirculating the wash liquid during the cycle of operation, the drain pump 68 for draining liquid from the treating chamber 16, and the diverter valve 62 for controlling the supply of liquid to one or more of the spray assemblies 34, 36, 38, 40 at a time. The controller 74 may be provided with a memory 78 and a central processing unit (CPU) or processor 80. The memory 78 may be used for storing control software that may be executed by the processor 80 in completing a cycle of operation using the dish treating appliance 10 and any additional software. For example, the memory 78 may store one or more pre-programmed cycles of operation that may be selected by a user and completed by the dish treating appliance 10. The controller 74 may also receive input from one or more sensors 82. Non-limiting examples of sensors that may be communicably coupled with the controller 74 include a temperature sensor and turbidity sensor to determine the soil load associated with a selected grouping of dishes, such as the dishes associated with a particular area of the treating chamber 16.

The memory 78 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s). The processor 80 can be implemented by, for example, one or more Atmel®, Intel®, AMD®, and/or ARM® microprocessors. Of course, other processors from other processor families and/or manufacturers are also appropriate.

The dish treating appliance 10 may include all of the above exemplary systems, a selection of the above exemplary systems, and/or other systems not listed above as desired. Further, some of the systems may be combined with other systems and/or may share components with other systems. Examples of other systems that the dish treating appliance may further include are a dispensing system that supplies one or more treating agents or chemistries to the treating chamber 16, heating system for heating the liquid contained in the sump 42, and/or an air supply system that may provide air, which may be heated or not heated, to the treating chamber 16, such as for drying and/or cooling the dishes.

Figure 3:
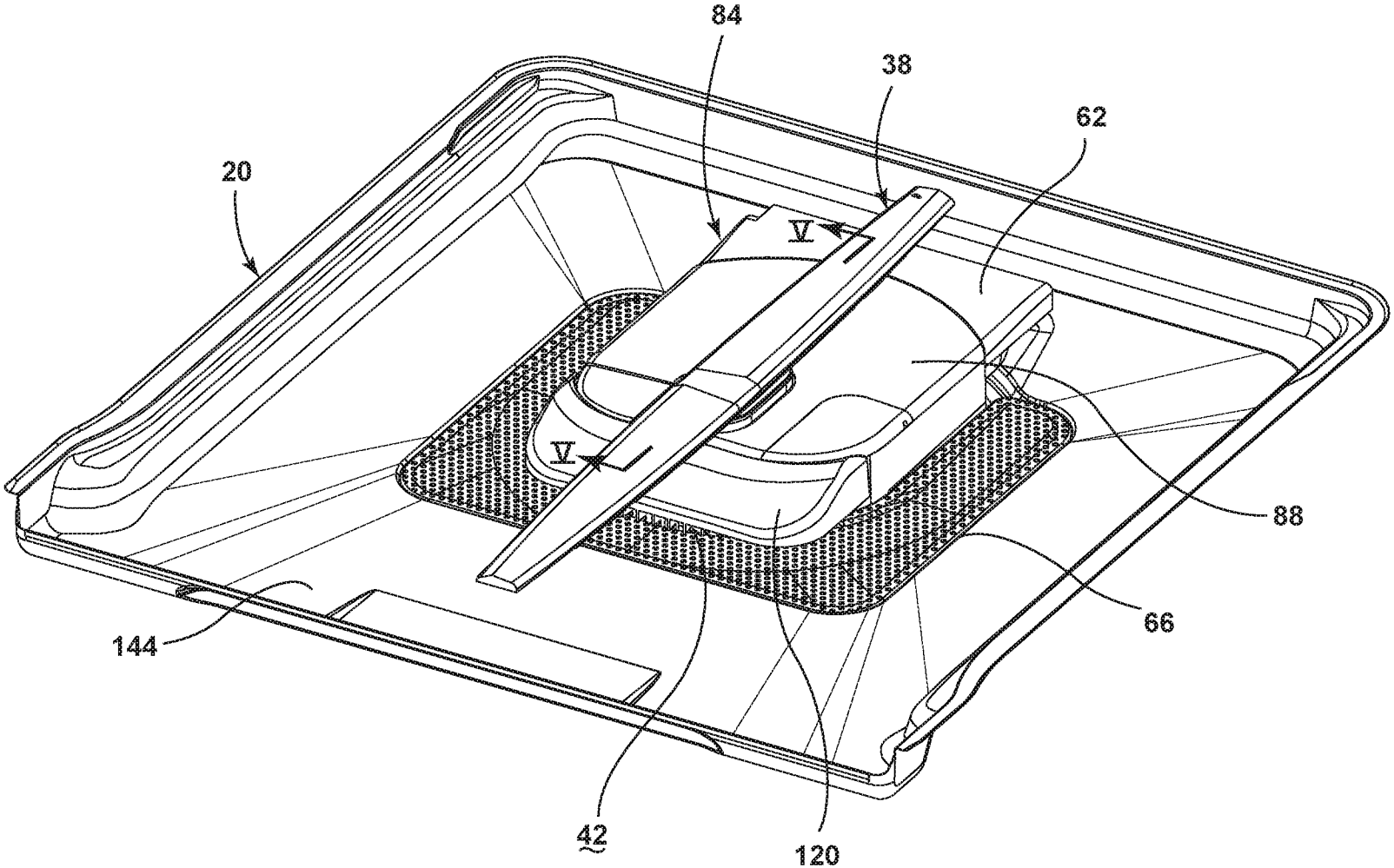
FIG. 3 is a perspective view of a detailed embodiment of the bottom wall and a portion of the recirculation system for the dish treating appliance of FIG. 1.
Figure 4:
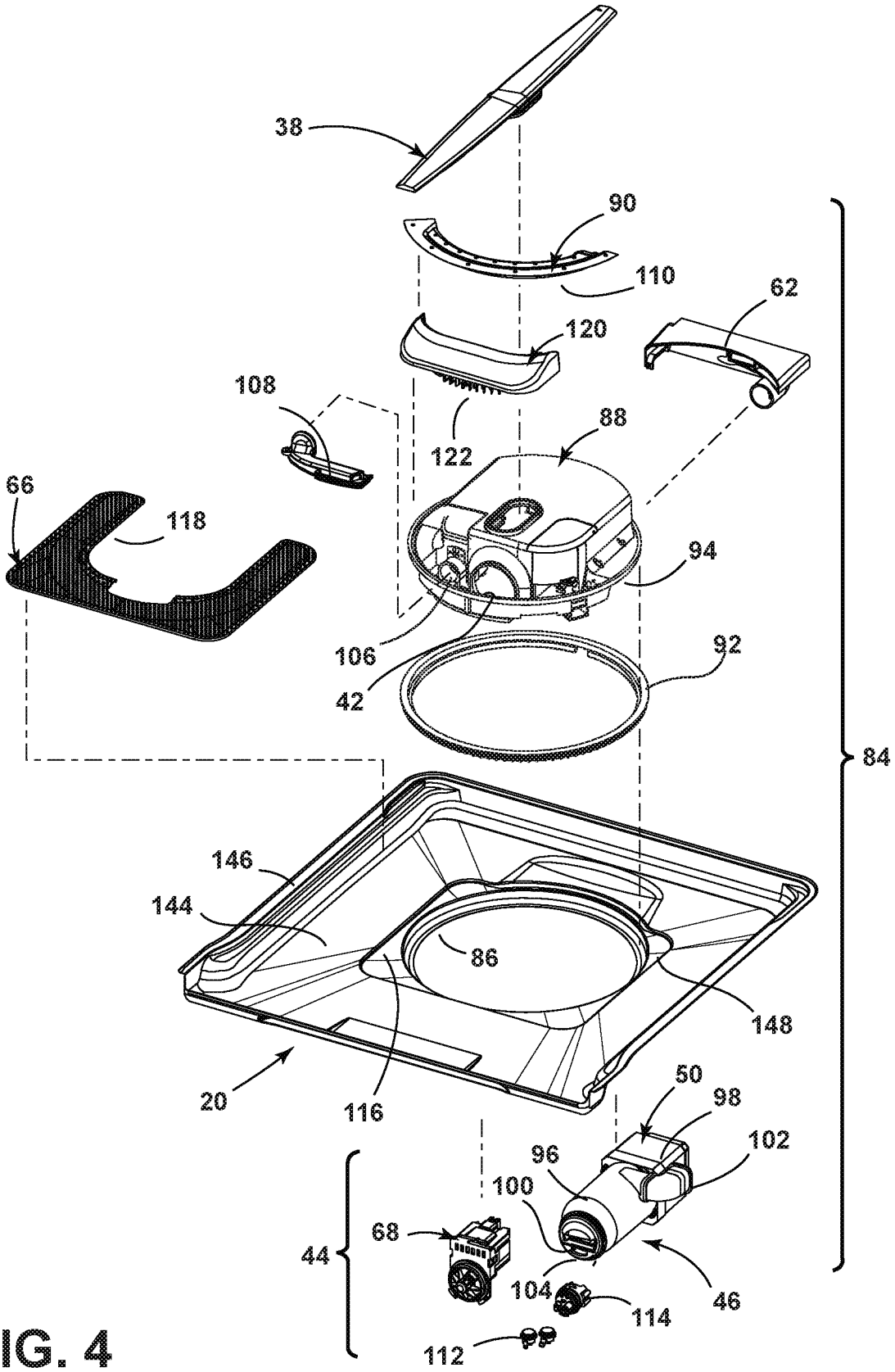
FIG. 4 is an exploded view of a sump unit of the recirculation system of FIG. 3.

FIGS. 3 and 4 show a detailed embodiment of a portion of the dish treating appliance in accordance with the present invention. The detailed embodiment shares many common elements with the schematic embodiment of FIG. 1, and like elements are numbered with corresponding reference numerals. FIG. 3 shows the bottom wall 20 and a portion of the recirculation system for the dish treating appliance. The bottom wall 20 is sloped downwardly toward a sump unit 84 which mounts the lower spray assembly 38 and includes the sump 42, which is partially visible below the coarse screen filter 66. As shown, the lower spray assembly 38 is mounted to a top portion of the sump unit 84. The diverter valve 62 is located at a rear portion of the sump unit 84.

FIG. 4 is an exploded view of the sump unit 84 from FIG. 3. The bottom wall 20 includes a bottom surface 144 that is sloped inwardly from a rectilinear edge 146 (which joins with or defines part of, for example, the rear wall 24 and side walls 26 shown in FIG. 1) to a central recessed area 148 that is lower than the bottom surface 144. The bottom surface 144 can effectively define the bottom wall 20, with the central recessed area 148 being considered as "below" the bottom wall 20. The recessed area 148 is provided with an opening 86 for accommodating at least a portion of the sump unit 84. The sump unit 84 includes a sump enclosure 88 having a recessed portion at least partially defining the sump 42. The sump enclosure 88 may house several components of the sump unit 84, including, but not limited to, the pump assembly 44 and a heater assembly 90.

A gasket 92 is provided between the bottom wall 20 and the sump enclosure 88 for sealing the interface between the sump unit 84 and the opening 86 in the bottom wall 20. The gasket 92 can define a perimeter, and the pump assembly 44 can be located within the perimeter defined by the gasket 92. The sump enclosure 88 may have a substantially circular perimeter edge 94, with the gasket 92 sealing the perimeter edge 94 with the bottom wall 20. Other perimeter shapes for the sump enclosure 88 are also possible.

The pump assembly 44 includes the housing 50, shown herein as including a pump housing 96 and a motor housing 98. The pump housing 96 further includes an inlet port 100 in fluid communication with the sump 42, a recirculation outlet port 102 in fluid communication with the diverter valve 62, and a drain outlet port 104 in fluid communication with the drain pump 68. In the embodiment shown herein, the drain outlet port 104 may be in fluid communication with an inlet 106 to the drain pump 68, shown herein as provided in the sump enclosure 88 via a drain conduit 108. Details of a suitable recirculation pump 46 can be found in U.S. application Ser. No. 14/731,511, filed Jun. 5, 2015, now U.S. Publication No. 20160353966, published Dec. 8, 2016, now abandoned, which is incorporated herein by reference in its entirety. Details of a suitable drain pump 68 can be found in U.S. application Ser. No. 14/551,131, filed Nov. 24, 2014, now U.S. Pat. No. 10,064,537, issued Sep. 4, 2018, which is incorporated herein by reference in its entirety.

The heater assembly 90 can include a heater 110 for heating wash liquid in the sump 42. A thermostat 112 is operably coupled with the heater 110 and senses the temperature of the wash liquid in the sump 42 and switches the heater 110 on or off as needed to maintain the temperature of the wash liquid at or near a desired setpoint. In some embodiments of the invention, the heater 110 may further heat air for drying dishes as well as the wash liquid in the sump 42. In this case, a fan or blower 114 may be provided as a component of the sump unit 84.

The coarse screen filter 66 is supported along its outer perimeter by a support edge 116 formed between the bottom surface 144 and the recessed area 148 of the bottom wall 20. The coarse screen filter 66 can seal against the support edge 116. The coarse screen filter 66 further includes a recessed portion 118 in its outer perimeter which defines an area for accommodating the sump enclosure 88. The coarse screen filter 66 extends over the sump 42 and inlet port 100 to separate the same from the treating chamber 16 (FIG. 1). The coarse screen filter 66 further keeps large soils and debris away from the heater assembly 90.

In addition to the coarse screen filter 66, a strainer 120 with depending ribs 122 is provided to prevent larger and/or longer objects or soils from entering the inlet port 100. The strainer 120 also reduces turbulence in the wash liquid around the inlet port 100, enabling the recirculation pump 46 to run with less wash liquid.

Figure 5:
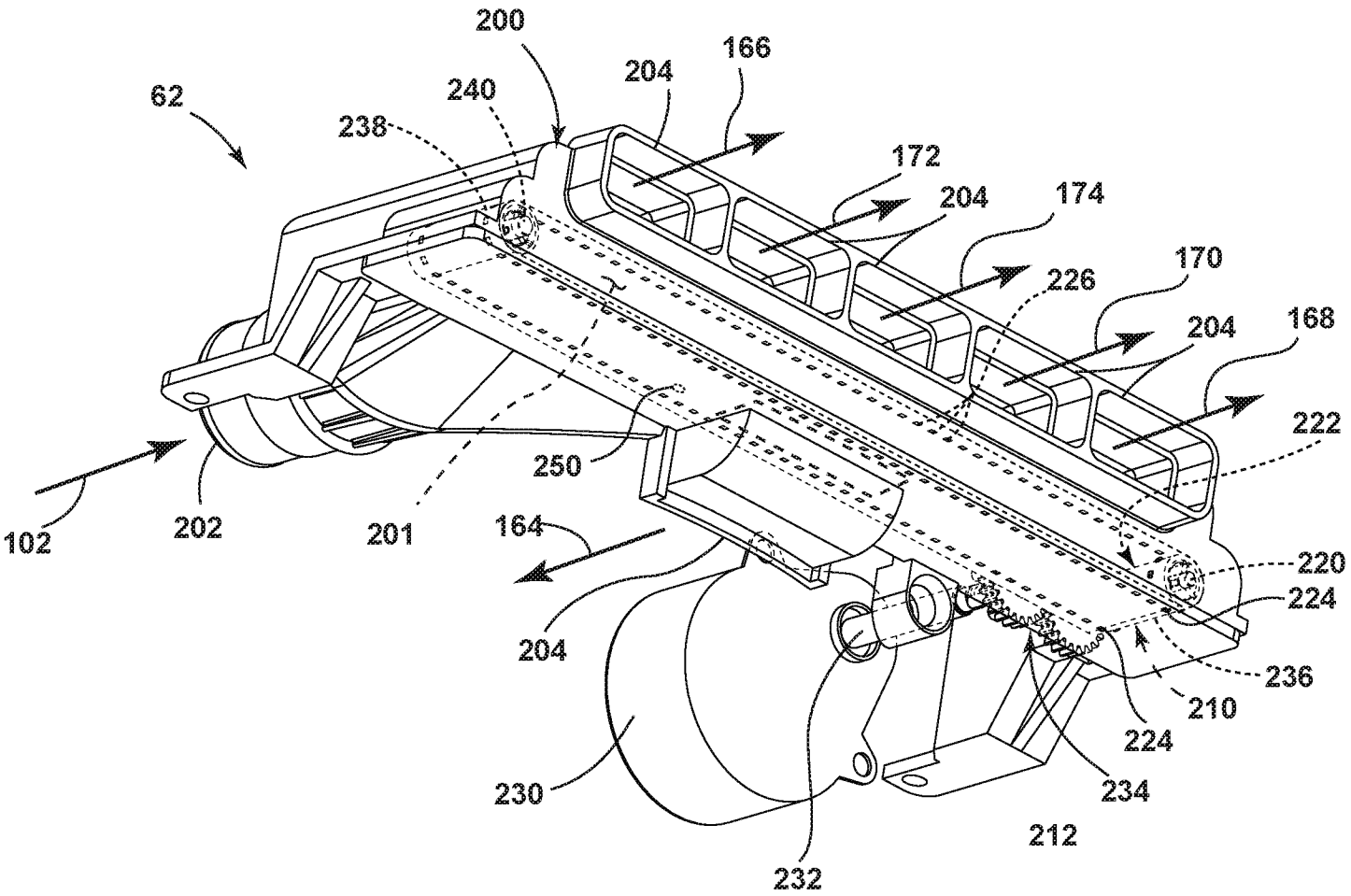
FIG. 5 is a rear perspective view of an exemplary diverter valve that can be utilized in the dish treating appliance of FIG. 1.
Figure 6:
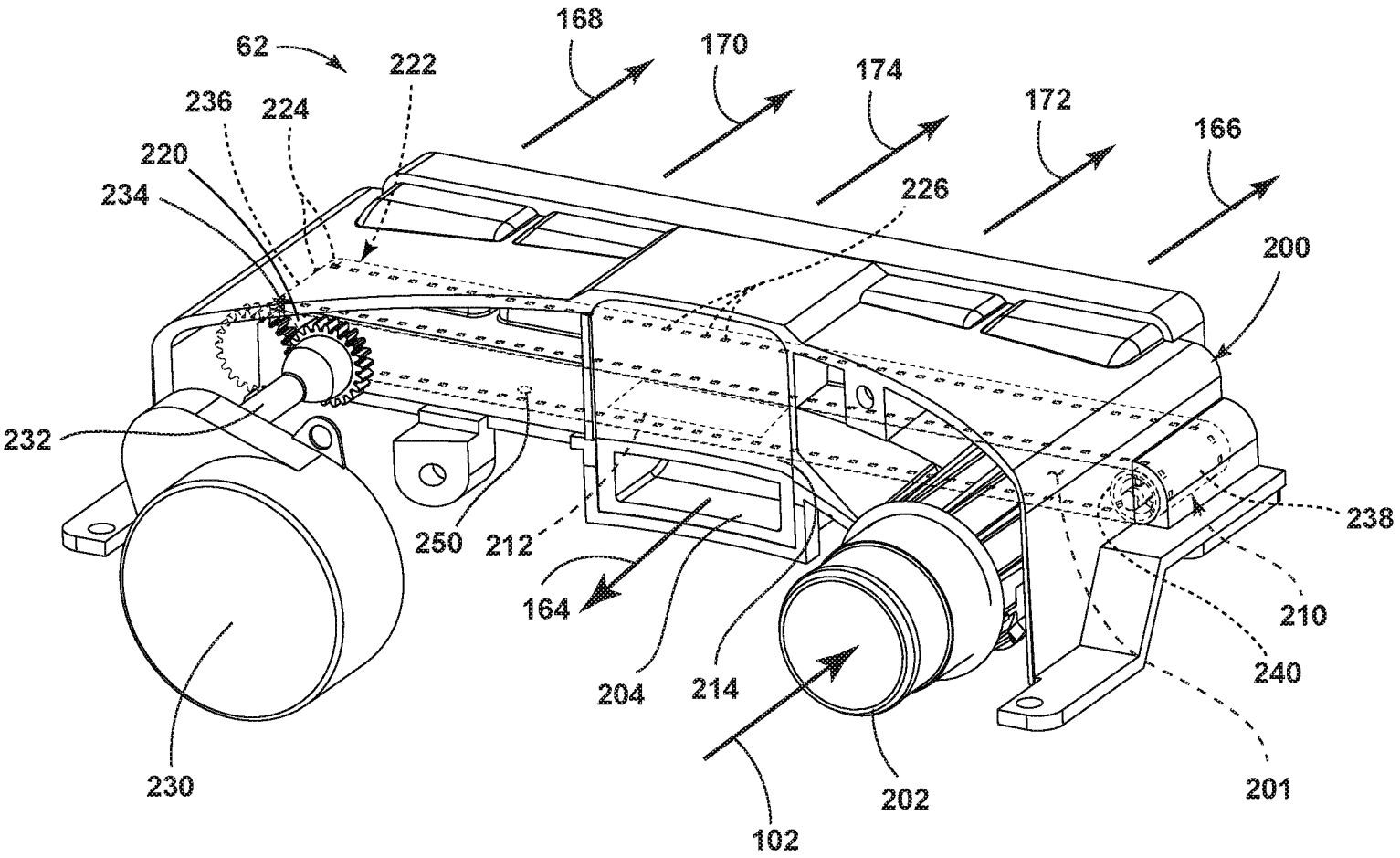
FIG. 6 is a front perspective view of the exemplary diverter valve of FIG. 3.

FIG. 5 illustrates an example of a diverter valve 62 having a manifold 200 defining a plenum 201 and having a plenum inlet 202 and a plurality of plenum outlets 204. The plenum inlet 202 can be fluidly coupled to the pump outlet port 102 of the recirculation pump 46, which has been schematically illustrated as an arrow 102. Each of the plenum outlets 204 fluidly couples to liquid conduits 164, 166, 168, 170, 172, and 174, which have been schematically illustrated as arrows. While the liquid conduit 164 has been illustrated on one side of the manifold 200 and the other liquid conduits 166-174 have been illustrated on another side, as better illustrated in FIG. 6, it will be understood that the manifold 200, plenum inlet 202, and plenum outlets 204 can be arranged in any suitable manner. It is contemplated that the number of plenum outlets 204 can correspond to the number of spray assemblies 34, 36, 38, 40. Alternatively, the plenum outlet(s) 204 can be fluidly coupled to a liquid circuit that can lead to more than one spray assembly and has additional conduits and valving to control the flow thereto.

Figure 7:
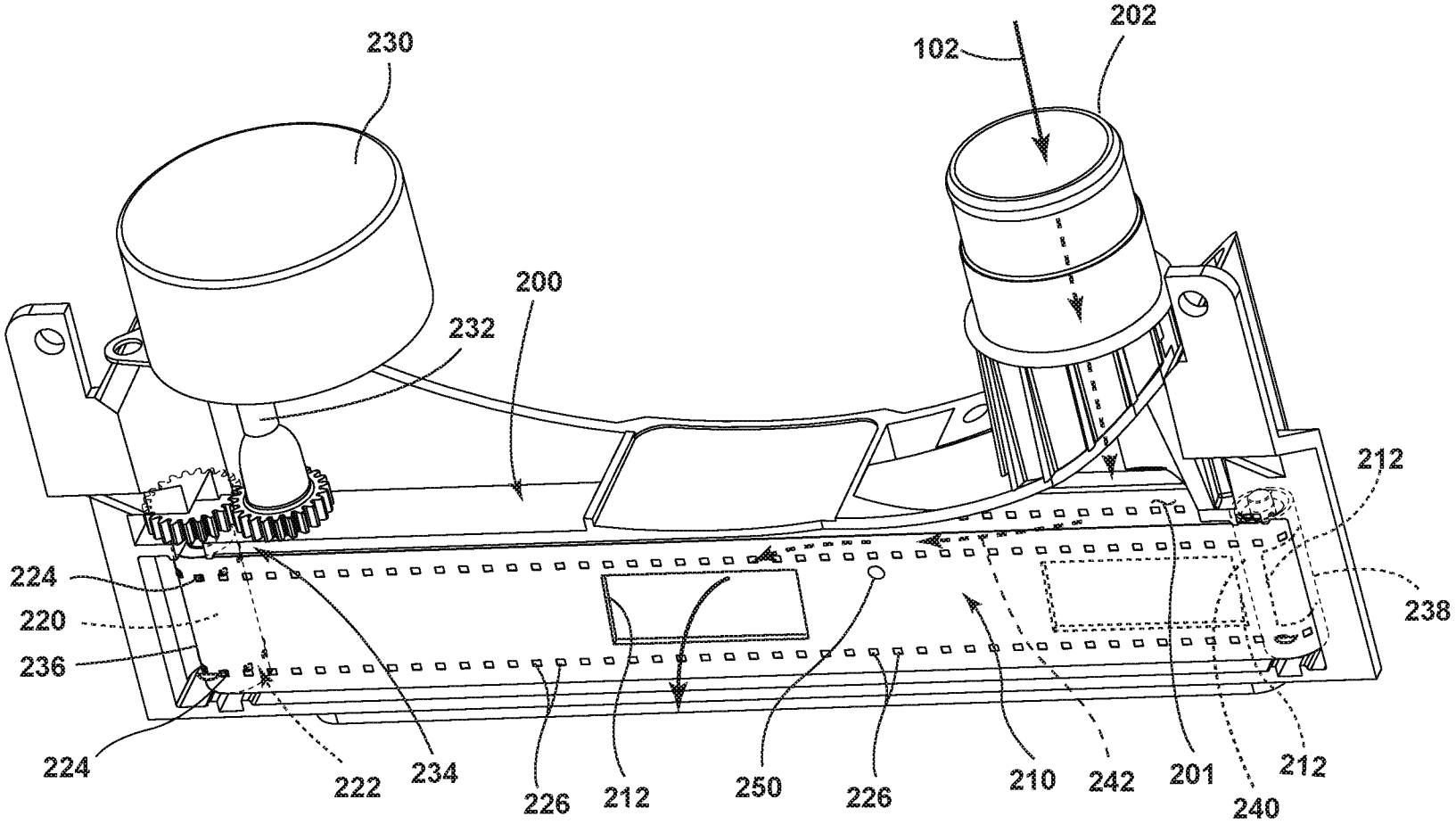
FIG. 7 is a bottom perspective view of the exemplary diverter valve of FIG. 3 with a portion of the housing removed for clarity.

Referring now to FIG. 7, a valve body in the form of a membrane strip 210 can be located within the plenum 201 and have at least one through opening 212. The membrane strip 210 can abut portions of the manifold 200 to form a liquid seal between the plenum outlets 204 and the remainder of the plenum 201. More specifically, the membrane strip 210 can abut an interior surface 214 (FIG. 8) of the manifold 200. The membrane strip 210 is movably mounted within the plenum 201 for movement along a path overlying the plurality of plenum outlets 204 such that the membrane strip 210 can be operable to selectively fluidly couple one of the plurality of plenum outlets 204 to a remainder of the plenum 201 and liquid therein. Movement of the membrane strip 210 can sequentially align the through opening 212 with one of the plenum outlets 204 while blocking at least another of the plenum outlets 204. The membrane strip 210 can be moveable to any number of positions such that different plenum outlets 204 can be fluidly coupled to the plenum 201. In this way, the different spray assemblies 34, 36, 38, 40 may be selected to be fluidly coupled to the recirculation pump 46 with the movement of the membrane strip 210. The membrane strip 210 can be formed from any suitable material including, but not limited to, a mylar membrane. It is contemplated that the membrane strip 210 can be flexible and such flex can allow the membrane strip 210 to provide a robust seal.

A spool 220 is illustrated in FIG. 7 and can be configured to hold the membrane strip 210 in place and aid in driving the membrane strip 210. The membrane strip 210 is illustrated herein as an endless belt. While not illustrated, the membrane strip 210 can alternately be a segment that is wound or unwound about the spool 220 during movement of the membrane strip 210. The segment of the membrane strip 210 can be wound or unwound as needed such that movement of the membrane strip 210 aligns one or more through openings 212 with select plenum outlets 204.

It is contemplated that any number of spools can be included within the diverter valve 62 to hold the membrane strip 210 in place and aid in driving the membrane strip 210. In the illustrated example, the membrane strip 210 includes a looped membrane strip formed from a continuous band, which forms an endless belt. The membrane strip 210 runs along the plenum outlets 204 and is held in place by a set of spools 220, 240. The spools 220, 240 are spaced apart from each other and the plenum outlets 204 lie between the two spools 220, 240. The continuous membrane strip 210 can have opposing ends 236, 238 with each end 236, 238 supported about a corresponding spool 220, 240, respectively.

The membrane strip 210 can be moveable utilizing any suitable driver or actuator. For example, one of the two spools 220, 240 can be driven externally to provide the rotation of the membrane strip 210. A drive including, but not limited to, a drive motor 230 can be operably coupled to the membrane strip 210 to move the membrane strip 210 within the plenum 201. By way of non-limiting example, the drive motor 230 has been illustrated as including an output shaft 232 that is operably coupled to the spool 220 to provide a driving force that turns the membrane strip 210. It is contemplated that the drive motor 230 can be a reversible drive motor and can be operably coupled to the controller 74 or another suitable controller. The controller 74 can control the operation of the drive motor 230 such that the membrane strip 210 can be driven in either a clockwise or counter-clockwise direction. In this manner the motor 230 can move the membrane strip 210 between any number of positions to fluidly couple any of the plenum outlets 204.

The friction between the spool 220 and the membrane strip 210 may not be substantial enough to ensure rotation of the membrane strip 210. Thus, a sprocket 222 having teeth 224 can be included on the spool 220. The membrane strip 210 includes holes 226 that mesh with the teeth 224 of the sprocket 222 and the contact between the teeth 224 and the holes 226 aids in driving the membrane strip 210.

An optional gear train 234 has been illustrated as operably coupling the output shaft 232 to the spool 220 such that rotation of the output shaft 232 moves the gear train 234, which in turn rotates the spool and moves the membrane strip 210 to any number of positions. The gear train 234 can be formed in any suitable manner including, but not limited to, that the gear train 234 can be a speed increasing gear train where the sprocket 222 is driven faster than the rotation of the shaft 232. The gear ratios of the gear train 234 can be selected in any suitable manner to control the movement of the membrane strip 210 based on the rotation of the shaft 232.

In the illustrated example, the membrane strip 210 has a through opening 212 in it that is aligned such that one of the bank of plenum outlets 204 is fluidly coupled at a time, such that liquid is provided to one of the spray assemblies 34, 36, 38, 40 at a time. Illustrated in dashed lines are additional multiple through openings 212. The use of additional multiple through openings 212, including through openings 212 spaced closely together can allow multiple spray assemblies 34, 36, 38, 40 to be fluidly coupled to the recirculation pump 46 simultaneously. Alternatively, the use of multiple through openings 212 can be utilized to vary the sequencing of the fluidly coupled spray assemblies 34, 36, 38, 40 depending on the location of the through openings 212 and the plenum outlets 204 in the manifold 200. It is also contemplated that the membrane strip 210 can include various sets of through openings 212 and the various sets of through openings 212 can define different liquid diversion or spray configurations or can be utilized for the same diversion configurations but allow for them to cycle through the path more frequently.

In this manner it will be understood that the membrane strip 210 can have different sets of openings for different functionalities or different phases of the wash cycle. By way of non-limiting example, a different set of through openings 212 could be provided for each selectable wash cycle, phase, or option. For example, a set of through openings 212 that are only supplied to the upper rack spray assembly 34 can be included for when a user selects an option to only wash in the upper rack 28. In this manner, a user can pick a zone or rack for washing and only those zones or rack would be sprayed. Alternatively, if a concentrated wash was selected, during one part of the cycle the second lower spray assembly 38 could be solely supplied to clean the dishes in the lower rack 32.

The operation of the dish treating appliance 10 with the diverter valve 62 as illustrated will now be described. The user will initially select a cycle of operation via the user interface 76, with the cycle of operation being implemented by the controller 74 controlling various components of the dish treating appliance 10 to implement the selected cycle of operation in the treating chamber 16. Examples of cycles of operation include normal, light/china, heavy/pots and pans, and rinse only. The cycles of operation can include one or more of the following phases: a wash phase, a rinse phase, and a drying phase. The wash phase can further include a pre-wash phase and a main wash phase. The rinse phase can also include multiple phases such as one or more additional rinsing phases performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the liquid recirculation system and then exits through the spray assemblies 34, 36, 38, 40.

During the cycle of operation the recirculation pump 46 can be operated to recirculate liquid to one or more of the spray assemblies 34, 36, 38, 40. To fluidly couple the one or more of the spray assemblies 34, 36, 38, 40 with the output of the recirculation pump 46, the membrane strip 210 can be selectively moved so as to selectively align the through opening(s) 212 with one or more of plenum outlets 204 to selectively enable liquid flow from the plenum 201 through the one or more plenum outlets 204 to control a flow of liquid from the recirculation pump 46 to the one of the spray assemblies 34, 36, 38, 40. FIG. 7 illustrates the membrane strip 210 having the through opening 212 in a position where the recirculation pump 46 via the diverter valve 62 is fluidly coupled with a plenum outlet 204, which leads to the liquid conduit 164. A flow of fluid is schematically illustrated with arrows 242. Fluid enters the plenum inlet 202 from the pump outlet port 102 and flows into the plenum 201. The fluid then flows through the through opening 212 and out the plenum outlet 204. In this manner, the output from the recirculation pump 46 is fluidly coupled to the lower spray assembly 38 via the diverter valve 62.

Figure 8:
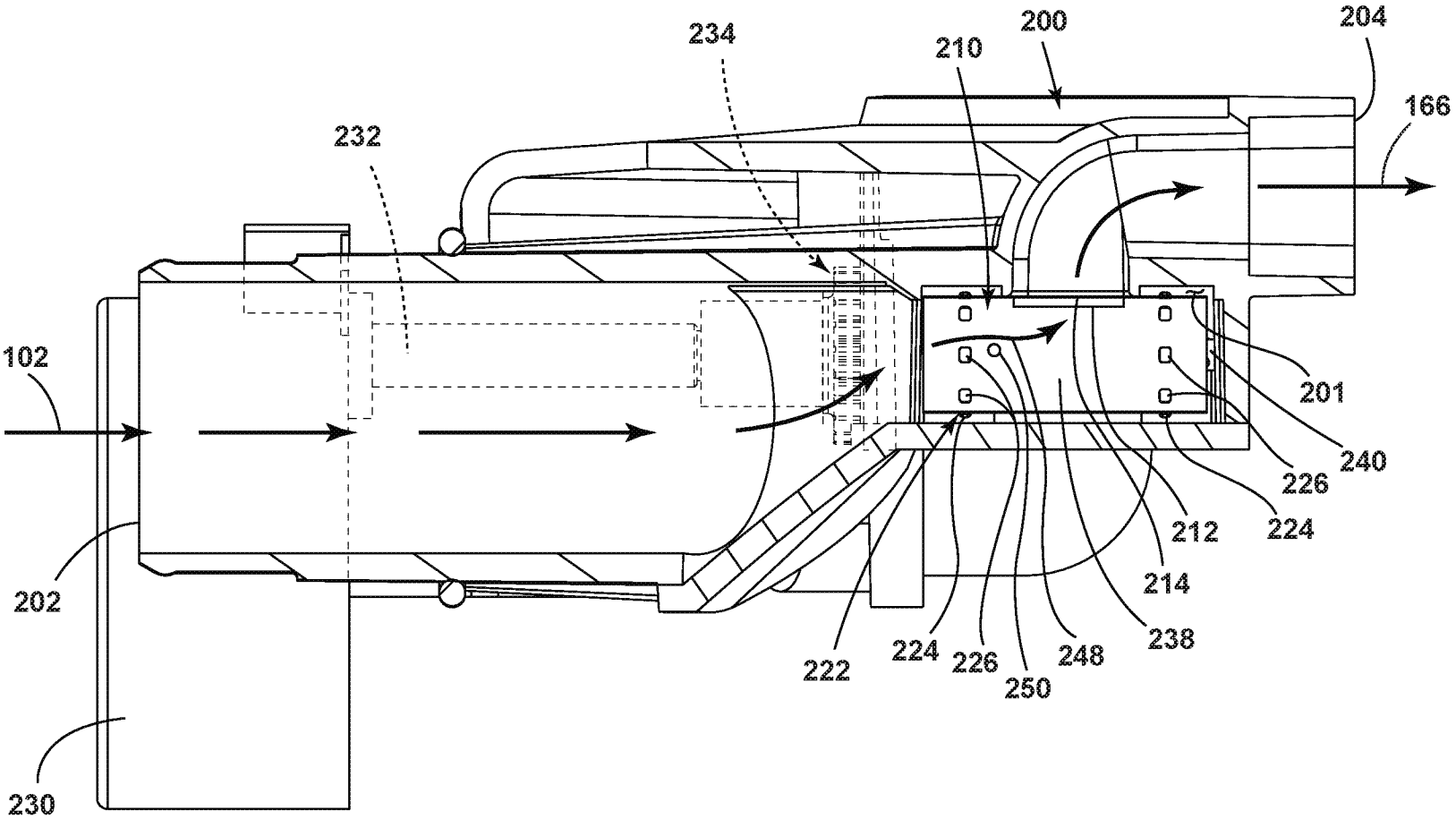
FIG. 8 is a cross-sectional view of the exemplary diverter valve with the valve body moved to fluidly couple an alternative plenum outlet.

The drive motor 230 can then be operated, including via the controller 74, to provide a driving force that turns the sprocket 222 and causes movement of the membrane strip 210 and the through opening 212 to a different position so that a different spray assembly can be fluidly coupled with the recirculation pump 46. By way of further non-limiting example, FIG. 8 illustrates the through opening 212 moved to fluidly couple with an alternative plenum outlet 204. More specifically, the through opening 212 is illustrated as fluidly coupling to the plenum outlet 204 that is fluidly coupled with the liquid conduit 166. A flow of fluid is schematically illustrated with arrows 248. Fluid enters the plenum inlet 202 from the pump outlet port 102 and flows into the plenum 201. The fluid then flows through the through opening 212 and out the plenum outlet 204. In this manner, the output from the recirculation pump 46 is fluidly coupled to the middle spray assembly 36 via the diverter valve 62.

Figure 9:
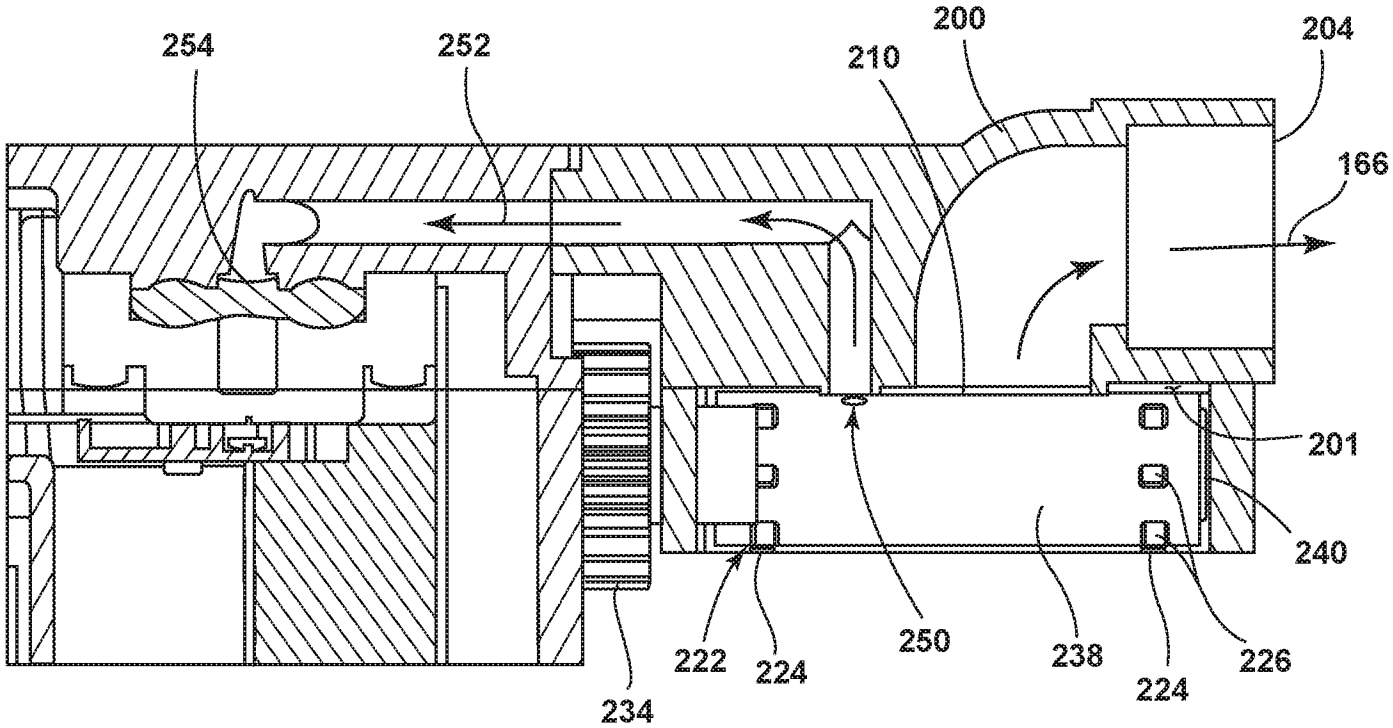
FIG. 9 is a cross-sectional view of an embodiment of the exemplary diverter valve of FIG. 4 having a pressure sensor for position sensing.

Turning now to FIG. 9, a sensor can be included in the dish treating appliance 10 including, but not limited to, that the sensor can be coupled with the diverter valve 62 to determine what plenum outlet 204 is fluidly coupled to the recirculation pump 46. The controller 74 can utilize the output from the sensor to determine the position of the through opening 212 and can control the movement of the membrane strip 210 based thereon. The output to the sensor comes from indicia 250 provided on the membrane strip 210 that corresponds to a relative position of the through opening 212 to the multiple outlets 204. The sensor is configured to sense the indicia 250 and provide an output of the sensed indicia 250 to determine the position of the through opening 212, such that as the membrane strip 210 is moved within the plenum 201, the sensor senses the indicia 250 and provides an output indicative of which of the multiple outlets 204 the through opening 212 is aligned with in order to define an aligned outlet 204.

In one embodiment of the invention, as illustrated in FIG. 9, the sensor can be provided as a pressure sensor 254 and the indicia 250 are provided as additional sensor openings in the membrane strip 210 that is in fluid connection with the plenum 201. A channel 252 extends within the manifold having one end terminating in connect with the membrane strip 210 and the other end terminating at a pressure sensor 254. The sensor opening indicia 250 correspond in a one-to-one manner with each of the outlets 204 such that the indicia 250 have a unique characteristic associated with each of the multiple outlets 204. This unique characteristic can be that the sensor opening indicia 250 have differing sizes for each of the different outlets 204. Furthermore, the membrane strip 210 in this exemplary embodiment can have two through openings 212, which are provided on opposite sides of the endless belt of the membrane strip 210. The two through openings 212 can have two sets of indicia 250, with each set of indicia 250 corresponding to a different one of the two through openings 212, so that the through opening 212 being aligned can also be identified.

Turning now to the operation of the pressure sensor 254, the channel 252 in the manifold 200 is positioned such that when one of the sensor opening indicia 250 is aligned with the opening of the channel 252, liquid flows from the plenum 201 through the channel 252 and comes into contact with a pressure sensor 254. The pressure of liquid in the sensor opening is sensed by the pressure sensor 254, which then provides an output. Because the sensor opening indicia 250 associated with each of the outlets 204 have varying lengths along the direction of movement, as the membrane strip 210 is moved, the pressure will be sensed for differing amounts of time between the different indicia 250. Assuming the membrane strip 210 always moves at the same speed, the length of time of the pressure reading would then be commensurate with the length of the opening of the indicia 250. Thus, the duration of the pressure reading at the pressure sensor 254 as the sensor opening indicia 250 move past the channel 252 provides a differentiable output that can be used to determine which of the multiple outlets 204 the through opening 212 is aligned with in order to define an aligned outlet 204.

In another embodiment, it is contemplated that that the sensor can be provided as an optical sensor. In this case, the indicia 250 can comprise reflective elements on the membrane. These reflective elements correspond in a one-to-one manner with each of the multiple plenum outlets 204 such that the indicia 250 have a unique characteristic associated with each of the multiple outlets 204. This unique characteristic can be a unique reflectance profile that is indicative of which of the multiple plenum outlets 204 is aligned with the through opening 212 of the membrane strip 210. As the indicia 250 move past the optical sensor, the optical sensor can sense the reflectance of the reflective elements in order to define an aligned outlet 204. It is also contemplated that the reflective element indicia 250 could have differing sizes such that the duration of the sensed reflectance as the indicia 250 move past the sensor can indicate the aligned outlet 204.

As an alternative to having a unique set of indicia 250 corresponding with each of the through openings 212, it is also considered that the membrane strip 210 could have just one sensor opening indicia 250, at a single position on the endless belt of the membrane strip 210 that is fluidly connected to the pressure sensor 254 by means of the channel 252. This single sensor opening indicia 250 could indicate a home position of the membrane strip 210 such that when the pressure sensor 254 detects the presence of fluid, the controller 74 would know that the membrane strip 210 was in the home position. The subsequent outlet 204 positions can then be determined by the length of time that the motor 230 has been operating since the membrane strip 210 was determined to be in the home position. This method requires an accurate motor 230 for moving the membrane strip 210 in order to provide precise timing. Non-limiting examples of such a precisely controller motor include a stepper motor or a timer motor.

In another embodiment, it is contemplated that the position of the through openings 212 can be sensed and determined by the use of a bit-encoder detection style accomplished by having multiple sensor opening indicia 250 of the same size associated with each of the plenum outlets 204. For example, if there were up to three sensor opening indicia 250 associated with each plenum outlet 204, each of the three openings can function as a bit such that the up to three bits can be used to differentiate between up to 6 positions that correspond to up to 6 plenum outlets 204. In a three-bit encoding system, each bit combination or code, would be representative of the position of one of the plenum outlets 204. The sensor opening indicia 250 define the bit patterns as they pass by the channel 252 that allows liquid to travel to the pressure sensor 254. As the sensor opening indicia 250 allow liquid to travel to the pressure sensor 254, the pattern of sensing of the water pressure can be used to identify which of the plenum outlets 204 the through opening 212 is lined up with. For even greater accuracy and flexibility in position determination, 4 or 5 bits could be used for the bit-encoder. The total number of bits required for the bit encoder would depend on how many positions or outlets 204 need to be detected.

The above-described embodiments provide a variety of benefits including that a diverter valve having the ability to direct fluid to only one of multiple available spray assemblies while fluidly sealing off other spray assemblies is provided with a method for consistently and accurately determining which position the through opening is in. Unlike current diverter valves, the above-described embodiments are easy to control because the position of the through opening can be easily determined. This allows for improved accuracy in operation of the diverter valve, eliminating the risk of the wrong plenum outlet being opened, as well as the risk of the through opening not being lined up properly with the selected plenum outlet and allowing fluid leakage.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure. Further, while the invention has been specifically described in connection with certain specific embodiments thereof, it is to be understood that this is by way of illustration and not of limitation.

The patentable scope of the invention is defined by the claims, and can include other examples that occur to those skilled in the art. It will be understood that any features of the above-described embodiments can be combined in any manner. Reasonable variation and modification are possible within the scope of the forgoing disclosure and drawings without departing from the spirit of the invention, which is defined in the appended claims.

What is claimed is:

1. A diverter valve assembly comprising:

a manifold defining a plenum with an inlet and multiple outlets;

a membrane comprising an endless belt movably mounted within the plenum and having at least one through opening, which is sequentially aligned with the multiple outlets upon movement of the membrane;

indicia provided on the membrane corresponding to each of the multiple outlets; and a sensor configured to sense the indicia and provide an output of the sensed indicia;

wherein as the membrane is moved within the plenum, the sensor senses the indicia and provides an output indicative of which of the multiple outlets the through opening is aligned with to define an aligned outlet.

2. The diverter valve assembly of claim 1 wherein the indicia comprises reflective elements on the membrane and the sensor is an optical sensor that senses a reflectance of the reflective elements.

3. The diverter valve assembly of claim 2 wherein the reflective elements correspond one-to-one to the multiple outlets.

4. The diverter valve assembly of claim 3 wherein the reflective elements have a unique reflectance and the unique reflectance indicates the aligned outlet.

5. The diverter valve assembly of claim 3 wherein the reflective elements have differing sizes and the duration of the reflectance as the indicia moves past the sensor indicates the aligned outlet.

6. The diverter valve assembly of claim 1 wherein the indicia comprises sensor openings in the membrane and the sensor is a pressure sensor that senses the pressure of liquid in the sensor opening.

7. The diverter valve assembly of claim 6 wherein the sensor openings correspond one-to-one to the multiple outlets.

8. The diverter valve assembly of claim 7 wherein the sensor openings have differing sizes and the duration of the pressure reading as the sensor openings move past the pressure sensor indicates the aligned outlet.

9. The diverter valve assembly of claim 1 wherein each of the indicia have a unique characteristic that is sensed by the sensor.

10. The diverter valve assembly of claim 9 wherein the unique characteristic is at least one of size or reflectance.

11. The diverter valve assembly of claim 10 wherein the unique characteristic is size and the duration of the indicia passing by the sensor during the movement of the membrane indicates the aligned outlet.

12. The diverter valve assembly of claim 11 wherein the endless belt further comprises at least two through openings, which are provided on opposite sides of the endless belt.

13. The diverter valve assembly of claim 12 further comprising two sets of indicia, with each set of indicia corresponding to a different one of the at least two through openings.

14. The diverter valve assembly of claim 1 wherein the endless belt further comprises at least two through openings, which are provided on opposite sides of the endless belt.

15. The diverter valve assembly of claim 14 further comprising two sets of indicia, with each set of indicia corresponding to a different one of the at least two through openings.

16. A diverter valve assembly comprising:

a manifold defining a plenum with an inlet and multiple outlets;

a membrane movably mounted within the plenum and having at least one through opening, which is sequentially aligned with the multiple outlets upon movement of the membrane, the membrane comprising a membrane strip segment that is wound or unwound about a spool during movement of the membrane strip segment;

indicia provided on the membrane corresponding to each of the multiple outlets; and a sensor configured to sense the indicia and provide an output of the sensed indicia;

wherein as the membrane is moved within the plenum, the sensor senses the indicia and provides an output indicative of which of the multiple outlets the through opening is aligned with to define an aligned outlet.

17. The diverter valve assembly of claim 16 wherein the indicia comprises reflective elements on the membrane and the sensor is an optical sensor that senses a reflectance of the reflective elements.

18. The diverter valve assembly of claim 16 wherein the indicia comprises sensor openings in the membrane and the sensor is a pressure sensor that senses the pressure of liquid in the sensor opening.

19. The diverter valve assembly of claim 16 wherein the membrane strip segment further comprises at least two through openings, which are provided on opposite ends of the membrane strip segment.

20. The diverter valve assembly of claim 19 further comprising two sets of indicia, with each set of indicia corresponding to a different one of the at least two through openings.

* * * * *